US008995690B2

(12) United States Patent
Hammerschmidt et al.

(10) Patent No.: US 8,995,690 B2
(45) Date of Patent: Mar. 31, 2015

(54) MICROPHONE AND METHOD FOR CALIBRATING A MICROPHONE

(75) Inventors: Dirk Hammerschmidt, Villach (AT); Michael Kropfitsch, Koettmannsdorf (AT); Andreas Wiesbauer, Poertschach (AT)

(73) Assignee: Infineon Technologies AG, Neubiberg (DE)

( * ) Notice: Subject to any disclaimer, the term of this patent is extended or adjusted under 35 U.S.C. 154(b) by 505 days.

(21) Appl. No.: 13/305,572

(22) Filed: Nov. 28, 2011

(65) Prior Publication Data

US 2013/0136267 A1 May 30, 2013

(51) Int. Cl.

| | |
|---|---|
| ***H04R 3/00*** | (2006.01) |
| ***H04R 3/06*** | (2006.01) |
| ***H04R 19/00*** | (2006.01) |
| ***H04R 29/00*** | (2006.01) |

(52) U.S. Cl.

CPC ..... *H04R 3/06* (2013.01); *H04R 19/005* (2013.01); *H04R 29/004* (2013.01)

USPC ..... 381/111; 381/58

(58) Field of Classification Search

USPC ..... 381/56, 58, 91, 95, 111, 113, 122, 174, 381/175, 190, 191, 59, 361; 310/322, 326, 310/334; 361/283.4; 73/715, 724

See application file for complete search history.

(56) References Cited

U.S. PATENT DOCUMENTS

| | | | | |
|---|---|---|---|---|
| 5,399,989 | A | 3/1995 | Chern | |
| 6,795,374 | B2 * | 9/2004 | Barnes et al. | 367/138 |
| 7,548,626 | B2 | 6/2009 | Stenberg et al. | |
| 8,004,350 | B2 | 8/2011 | Draxelmayr | |
| 8,067,958 | B2 | 11/2011 | Draxelmayr | |
| 2002/0039463 | A1 | 4/2002 | Degertekin et al. | |
| 2003/0155966 | A1 | 8/2003 | Harrison | |
| 2005/0219953 | A1 | 10/2005 | Bayram et al. | |
| 2006/0008097 | A1 * | 1/2006 | Stenberg et al. | 381/113 |
| 2006/0034472 | A1 * | 2/2006 | Bazarjani et al. | 381/111 |
| 2006/0083392 | A1 | 4/2006 | Akino | |
| 2007/0089496 | A1 * | 4/2007 | Degertekin | 73/104 |
| 2008/0075306 | A1 | 3/2008 | Poulsen et al. | |
| 2009/0134501 | A1 | 5/2009 | Ganitzer et al. | |

(Continued)

FOREIGN PATENT DOCUMENTS

| | | | |
|---|---|---|---|
| DE | 20 2011 106 756 | U1 | 4/2012 |
| EP | 1599067 | B1 | 5/2005 |

(Continued)

OTHER PUBLICATIONS

Oralkan, O., et al., "Experimental Characterization of Collapse-Mode CMUT Operation," IEEE Transactions on Ultrasonics, Ferroelectrics, and Frequency Control, Aug. 2006, 1513-1523, vol. 53, No. 8.

(Continued)

*Primary Examiner* — Vivian Chin
*Assistant Examiner* — Friedrich W Fahnert
(74) *Attorney, Agent, or Firm* — Slater & Matsil, L.L.P.

(57) ABSTRACT

A microphone and a method for calibrating a microphone are disclosed. In one embodiment the method for calibrating a microphone comprises operating a MEMS device based on a first AC bias voltage, measuring a pull-in voltage, calculating a second AC bias voltage or a DC bias voltage, and operating the MEMS device based the second AC bias voltage or the DC bias voltage.

23 Claims, 2 Drawing Sheets

(56) References Cited

U.S. PATENT DOCUMENTS

| | | | | |
|---|---|---|---|---|
| 2011/0056302 | A1 | 3/2011 | Lutz | |
| 2011/0142261 | A1 | 6/2011 | Josefsson | |
| 2011/0150243 | A1 | 6/2011 | Onishi | |
| 2011/0175243 | A1 | 7/2011 | Jo et al. | |
| 2012/0104898 | A1* | 5/2012 | Qu et al. | 310/319 |
| 2013/0015919 | A1 | 1/2013 | Kropfitsch et al. | |
| 2013/0051582 | A1 | 2/2013 | Kropfitsch et al. | |
| 2013/0129116 | A1 | 5/2013 | Kropfitsch et al. | |
| 2013/0271307 | A1 | 10/2013 | Kropfitsch et al. | |
| 2013/0277776 | A1* | 10/2013 | Herzum et al. | 257/416 |
| 2013/0287231 | A1 | 10/2013 | Kropfitsch | |

FOREIGN PATENT DOCUMENTS

| | | | |
|---|---|---|---|
| EP | 1 906 704 | A1 | 4/2008 |
| EP | 2223654 | A1 | 9/2010 |
| EP | 2653846 | A1 | 10/2013 |
| WO | WO 2009/135815 | A1 | 11/2009 |

OTHER PUBLICATIONS

Delbrueck, Tobi, et al., "Analog VLSI Adaptive, Logarithmic, Wide-Dynamic-Range Photoreceptor," Proceedings of IEEE International Symposium on Circuits and Systems ISCAS 94, May 30-Jun. 2, 1994, 4 pages.

Feng, P., et al., "History of the High-Voltage Charge Pump," Book Expert, Chapter 1, Professional Engineering 6×9; Charge Pump Circuit Design, Nov. 2006, pp. 1-9.

Harrison, R.R., "Integrated Circuits for Neural Interfacing," Circuits for Emerging Technologies, Feb. 15, 2008, pp. 1-12.

Harrison, R.R., et al., "A Low-Power Low-Noise CMOS Amplifier for Neural Recording Applications," IEEE Journal of Solid-State Circuits, vol. 38, No. 6, Jun. 2003, pp. 958-965.

Vittoz, E., et al., "CMOS Analog Integrated Circuits Based on Weak Inversion Operation," IEEE Journal of Solid-State Circuits, vol. SC-12, No. 3, Jun. 1997, pp. 224-231.

* cited by examiner

MICROPHONE AND METHOD FOR CALIBRATING A MICROPHONE

TECHNICAL FIELD

The present invention relates generally to a microphone and a method for calibrating a microphone.

BACKGROUND

MEMS (microelectromechancial system) devices are generally manufactured in large numbers on semiconductor wafers.

A significant problem in the production of MEMS devices is the control of physical and mechanical parameters of these devices. For example, parameters such as mechanical stiffness, electrical resistance, diaphragm area, air gap height, etc. may vary by about +/−20% or more.

The variations of these parameters on the uniformity and performance of the MEMS devices may be significant. In particular, parameter variations are especially significant in a high volume and low-cost MEMS (microphones) manufacturing process where the complexity is low. Consequently, it would be advantageous to compensate for these parameter variations.

SUMMARY OF THE INVENTION

In accordance with an embodiment of the present invention a method for calibrating a MEMS comprises operating a MEMS based a first AC bias voltage, measuring a pull-in voltage of the MEMS, calculating a second AC bias voltage or DC bias voltage, and operating the MEMS based the second AC bias voltage.

In accordance with an embodiment of the present invention a method for calibrating a MEMS comprises increasing a first AC bias voltage at the membrane, detecting a first pull-in voltage and setting a second AC bias voltage or DC bias voltage for the membrane based on the first pull-in voltage. The method further comprises applying a first defined acoustic signal to the membrane and measuring a first sensitivity of the microphone.

In accordance with an embodiment of the invention a microphone comprises a MEMS device comprising membrane and a backplate, an AC bias voltage source connected to the membrane, and a DC bias voltage source connected to the backplate.

In accordance with an embodiment of the invention an apparatus comprises a MEMS device for sensing an acoustic signal, a bias voltage source for providing an AC bias voltage to the MEMS device, and a control unit for detecting a pull-in voltage and for setting the AC bias voltage or a DC bias voltage.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

Figure 1:
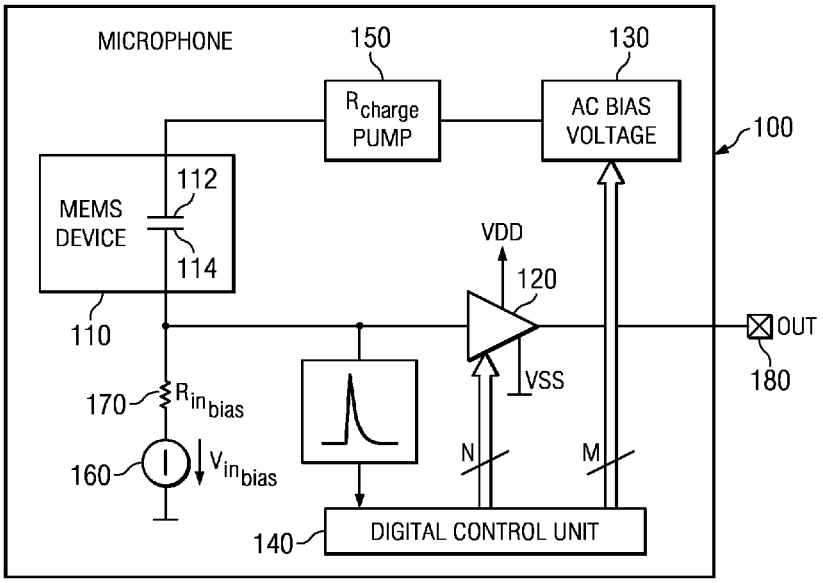
FIG. 1 shows a block diagram of a microphone.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to embodiments in a specific context, namely a microphone. The invention may also be applied, however, to other types of systems such as audio systems, communication systems, or sensor systems.

In a condenser microphone or capacitor microphone, a diaphragm or membrane and a backplate form the electrodes of a capacitor. The diaphragm responds to sound pressure levels and produces electrical signals by changing the capacitance of the capacitor.

The capacitance of the microphone is a function of the applied bias voltage. At negative bias voltage the microphone exhibits a small capacitance and at positive bias voltages the microphone exhibits increased capacitances. The capacitance of the microphone as a function of the bias voltage is not linear. Especially at distances close to zero the capacity increases suddenly.

A sensitivity of a microphone is the electrical output for a certain sound pressure input (amplitude of acoustic signals). If two microphones are subject to the same sound pressure level and one has a higher output voltage (stronger signal amplitude) than the other, the microphone with the higher output voltage is considered having a higher sensitivity.

The sensitivity of the microphone may also be affected by other parameters such as size and strength of the diaphragm, the air gap distance, and other factors.

The condenser microphone may be connected to an integrated circuit such as an amplifier, a buffer or an analog-to-digital converter (ADC). The electrical signal may drive the integrated circuit and may produce an output signal. In one embodiment, the gain of a feedback amplifier may be adjusted or calibrated by varying the ratio of a set of resistors, a set of capacitors, or a set of resistors and capacitors that are coupled as a feedback network to the amplifier. The feedback amplifier can be either single ended or differential.

In a MEMS manufacturing process the pressure-sensitive diaphragm is etched directly into a silicon chip. The MEMS device is usually accompanied with integrated preamplifier. MEMS microphones may also have built in analog-to-digital converter (ADC) circuits on the same CMOS chip making the chip a digital microphone and so more readily integrated with modern digital products.

According to an embodiment of the invention, a combination of AC bias voltage adjustment and an amplifier gain adjustment allows the adjustment of the microphone. According to an embodiment of the invention, the microphone is calibrated during operation with an AC bias voltage. In one embodiment of the invention the operating AC bias voltage is set based on a pull-in voltage of the membrane.

In one embodiment it is advantageous to operate the microphone with the highest possible bias voltage. The higher the bias voltage the more sensible is the microphone. The higher the sensibility of the microphone the better is the signal to noise ratio (SNR) the microphone system.

FIG. 1 shows a block diagram of a microphone 100. The microphone 100 comprises a MEMS device 110, an amplifier unit 120, an AC bias voltage source 130 and a digital control unit 140.

The AC bias voltage source 130 is electrically connected to the MEMS device 110 via resistor $R_{charge\ pump}$ 150. In particular, the AC bias voltage source 130 is connected to the membrane or diaphragm 112 of the MEMS device 110. The backplate 114 of the MEMS device 110 is connected to the DC bias voltage source 160 via the resistor $R_{inbias}$ 170. The MEMS device 110 is electrically connected to an input of an amplifier unit 120. An output of the amplifier unit 120 is electrically connected to an output terminal 180 of the microphone 100 or to an analog-digital converter ADC (not shown).

Digital control lines connect the digital control unit 140 to the amplifier unit 120 and the AC bias voltage source 130. The digital control unit 140 may comprise a glitch detection circuit. An embodiment of the glitch detection circuit is disclosed in co-pending application application Ser. No. 13/299,098 which is incorporated herein by reference in its entirety. The digital control unit 140 or the glitch detection circuit detects a pull-in or collapse voltage ($V_{pull\text{-}in}$) at an input of the amplifier unit 120. The digital control unit 140 also measures the sensitivity of the output signal of the amplifier unit 120 and controls the AC bias voltage source 130. Memory elements such as volatile or non-volatile may be embedded in the digital control unit 140 or may be a separate element in the microphone 100.

During calibration operation of the microphone 100 a first AC bias voltage (comprising of an AC component provided by the AC bias voltage source 130 and a DC component provided by the bias voltage source 160) is applied to the MEMS device 110. The first AC bias voltage is increased until the backplate 114 and the membrane 112 collapse or until the distance between the backplate 114 and the membrane 112 is minimized, e.g., zero. The pull in voltage ($V_{pull\text{-}in}$) is measured or detected by the digital control unit 140. The pull in voltage ($V_{pull\text{-}in}$) may be detected by a voltage jump at the input of the amplifier unit 120. A second AC bias voltage is derived from the pull in voltage ($V_{pull\text{-}in}$). The second AC bias voltage may be stored in the memory elements.

The first AC bias voltage may comprise a maximal amplitude of an AC component of about 1% to about 20% of a value of the DC component. Alternatively, the AC component may be about 10% to about 20% of the value of the DC component. For example, the DC voltage $V_{DC}$ may be about 5 V and the AC voltage $V_{AC}$ may be about 0.5 V to about 1 V. Alternatively, the AC component may comprise other values of the DC component, e.g., higher values or lower values. The second AC bias voltage may comprise a maximal amplitude of an AC component comprises about 0% to about 20% of a value of the DC component because the microphone can also be operated with a DC bias voltage.

According to an embodiment of the invention, a DC voltage is superimposed with an AC voltage. The first AC bias voltage may comprise a low frequency such as a frequency of up to 500 Hz or up to 200 Hz. Alternatively, the first AC bias voltage may comprise a frequency from about 1 Hz to about 50 Hz. The second AC bias voltage may comprise a low frequency such as a frequency of up to 500 Hz or up to 200 Hz. Alternatively, the second AC bias voltage may comprise a frequency from about 0 Hz to about 50 Hz.

After setting the second AC bias voltage a defined acoustic signal is applied to the microphone 100. The sensitivity of the microphone 100 is measured at the output terminal 180 and compared to a target sensitivity of the microphone 100. The control unit 140 calculates a gain setting so that the microphone meets its target sensitivity. The gain setting is also stored in the memory elements.

Figure 2A:
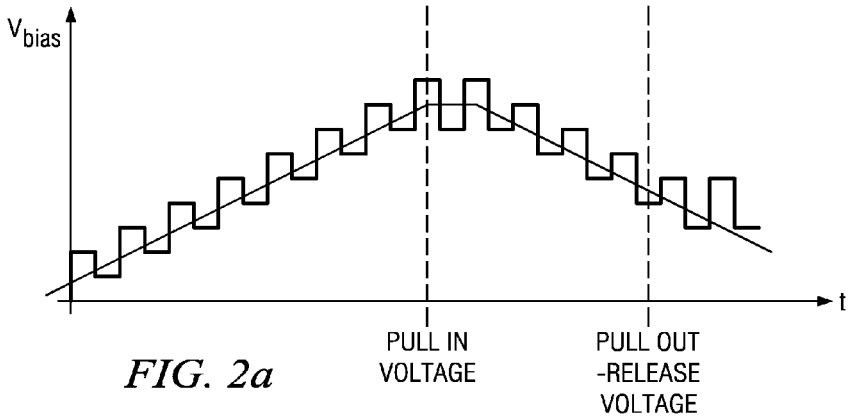
FIGS. 2*a*-2*c* show functional diagrams.
Figure 2B:
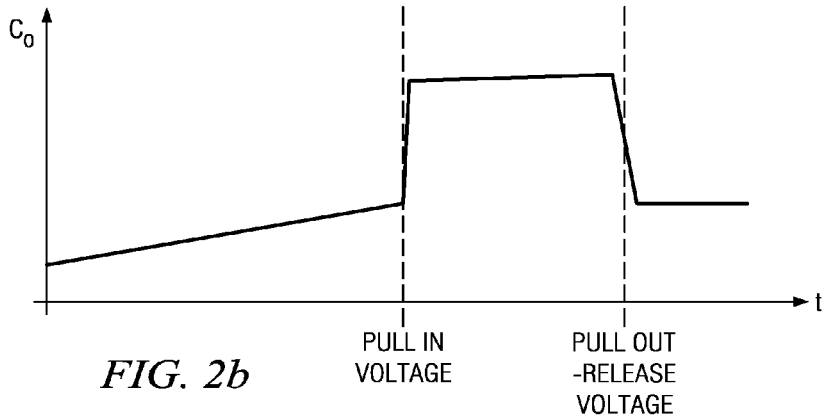
Figure 2C:
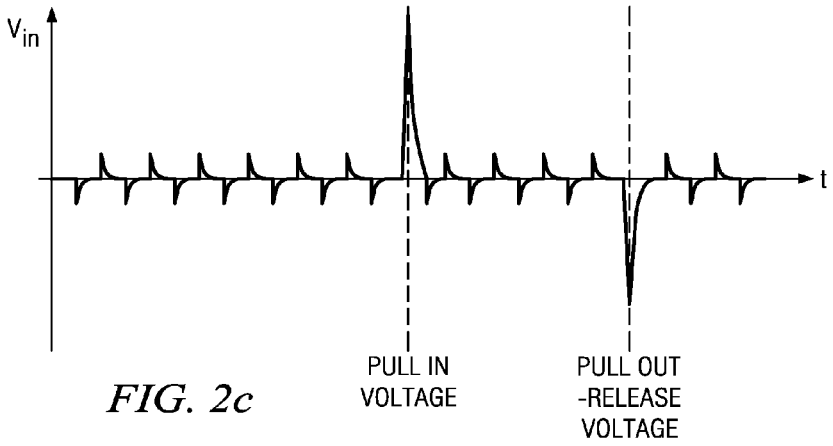

FIGS. 2*a*-2*c* show different functional diagrams. FIG. 2*a* shows a diagram wherein the vertical axis corresponds to the AC bias voltage $V_{bias}$ and the horizontal axis represents the time t. The AC bias voltage $V_{bias}$ comprises a DC component and an AC component. FIG. 2*a* shows the AC bias voltage $V_{bias}$ as DC voltage superimposed with an AC voltage. In one embodiment the AC bias voltage $V_{bias}$ can be increased/decreased by increasing the DC component and by keeping the AC component constant. Alternatively, the AC bias voltage $V_{bias}$ can be increased by increasing/decreasing the DC component and increasing/decreasing the AC component. The AC bias voltage may be a periodic sine voltage or a periodic square wave voltage. The AC component may be set for the possible tolerance of the pull in voltage.

In a MEMS calibration process, the AC bias voltage $V_{bias}$ may be increased up to the pull-in voltage event and then decreased until at least the release voltage event. FIG. 2*b* shows a diagram wherein the vertical axis corresponds to the capacity of the MEMS $C_0$ and the horizontal axis corresponds to the time t. The graph in FIG. 2*b* shows the capacitance changes of the MEMS $C_0$ over time with increasing/decreasing AC bias voltage $V_{bias}$. The graph shows two significant steps. The capacitance of the MEMS $C_0$ changes slightly in a first region up to the pull in voltage event. Around and at the pull-in voltage event the capacitance $C_0$ increases substantially. Thereafter, the AC bias voltage $V_{bias}$ is decreased and the capacitance $C_0$ does not change or barely changes the capacitance $C_0$ until the pull out voltage event (or release voltage event). Around and at the pull-out voltage event the capacitance decreases substantially.

FIG. 2*c* shows a diagram wherein the y-axis corresponds to the input voltage $V_{in}$ at the input of the amplifier unit and the horizontal axis represents the time t. The input voltage $V_{in}$ shows small positive and negative amplitudes or voltage impulses. In the event that the membrane and the backplate touch each other, the amplitude is substantially larger than the regular voltage impulses. Similar, in the event that the membrane and the backplate are released from each other, the amplitude is substantially larger than the regular voltages impulses.

When the AC bias voltage $V_{bias}$ is increased until the membrane and the backplate touch each other and the pull in voltage is reached, the MEMS capacitance changes substantially. A glitch occurs at the input of the amplifier unit 120 and the information is processed in the control logic unit 140. After this event, the AC bias voltage $V_{bias}$ can be reduced in one embodiment, until the membrane and the backplate separate. At this event, the MEMS capacitance $C_0$ is reduced to its original value and a voltage glitch at the input of the amplifier unit 120 is visible again. This indicates the pull out voltage or release voltage.

Figure 3:
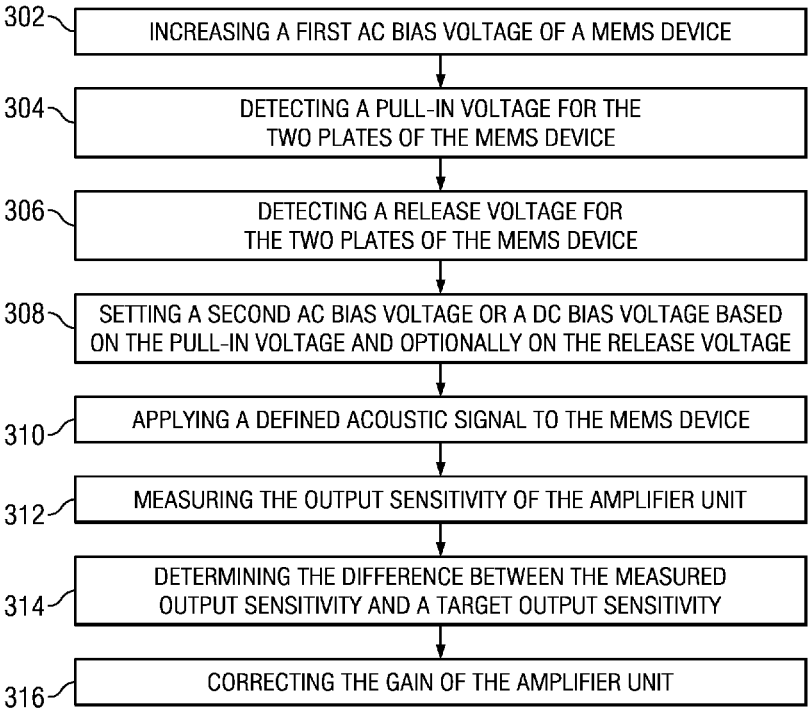
FIG. 3 shows a flow chart of an embodiment of a calibration of a microphone.

FIG. 3 shows a flow chart of a calibration process for a microphone. The flow chart includes two global steps and eight detailed steps. In a first global step a second AC bias voltage is set and in a second global step the amplifier gain is calculated based on the measured sensitivity of the microphone. To measure the sensitivity of the microphone a first AC bias voltage is applied to the membrane wherein the first AC bias voltage comprises an AC component from the AC bias voltage source and a DC component from the DC bias voltage source applied to the backplate.

In a first detail step 302 the digital control unit starts the calibration process by increasing a first AC bias voltage biasing the MEMS device. The AC bias voltage may be increased as shown in FIG. 2*a*. Increasing the first AC bias voltage leads eventually to a collapse of the membrane and the backplate. In step 304 the collapse or pull-in voltage is detected by a significant positive jump of the input voltage $V_{in}$ as soon as the membrane and the backplate touch each other. An example can be seen in FIG. 2*c*. The pull-in voltage ($V_{pull\text{-}in}$) may be defined as the pull-in voltage with the lowest voltage necessary to collapse the two plates. This event may be detected by the digital control unit at the input of the amplifier unit. After detecting the pull-in voltage, the digital control unit may stop increasing the AC bias voltage.

In optional step 306 the digital control unit may decrease the AC bias voltage (through the AC bias voltage source). The AC bias voltage may be decreased as shown in FIG. 2*a*. The release voltage or pull-out voltage is detected by a significant negative jump of the input voltage $V_{in}$ as soon as the membrane and the backplate release or separate from each other. An example can be seen in FIG. 2*c*. This event may be detected by the digital control unit at the input of the amplifier unit. After detecting the release voltage, the digital control unit may stop decreasing the AC bias voltage.

In step 308, the digital control unit sets a second AC bias voltage or a DC bias voltage based on the detected pull-in voltage ($V_{pull\text{-}in}$) and, optionally, based on the release voltage $V_{release}$. For example, the second AC bias voltage or DC bias voltage ($V_{FAC}$) can be set as $V_{FAC}=V_{release}-V_{margin}$, wherein $V_{margin}$ depends on the expected sound levels. The value of $V_{FAC}$ may be stored in the memory elements.

In step 310, a defined acoustic signal is applied to the MEMS device. The MEMS device is biased with the second AC bias voltage $V_{FAC}$ or the DC bias voltage. The digital control unit may measure an output sensitivity of the amplifier unit at the output terminal (step 312). Then, in step 314, the digital control unit may calculate a difference between the target sensitivity and the measured output sensitivity. Finally, in step 316, the digital control unit calculates a gain setting for the amplifier unit in order to match the measured output sensitivity with the target output sensitivity. The digital control unit may store the gain setting parameters in or outside of the digital control unit.

Although the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for calibrating a microphone, the method comprising:

operating a MEMS device based on a first AC bias voltage;

measuring a pull-in voltage;

calculating a second AC bias voltage or DC bias voltage; and operating the MEMS device based the second AC bias voltage or DC bias voltage.

2. The method according to claim 1, wherein the first AC bias voltage comprises a first DC component and a first AC component and wherein the second AC bias voltage comprises a second DC component and/or a second AC component.

3. The method according to claim 2, wherein a maximal first amplitude of the first AC component comprises about 1% to about 20% of a value of the first DC component, and wherein a maximal second amplitude of the second AC component comprises about 1% about 20% of a value of the second DC component.

4. The method according to claim 2, wherein the first AC component comprises a frequency between about 1 Hz and about 50 Hz.

5. The method according to claim 1, wherein the first AC bias voltage is higher than the second AC bias or DC bias voltage.

6. The method according to claim 1, further comprising measuring a release voltage.

7. The method according to claim 6, wherein calculating the second AC bias voltage or DC bias voltage is based on a difference between the measured pull-in voltage and the measured release voltage.

8. A method for calibrating a microphone, the method comprising:

increasing a first AC bias voltage;

detecting a pull-in voltage;

setting a second AC bias voltage or DC bias voltage based on the pull-in voltage;

applying a defined acoustic signal to a membrane of the microphone; and measuring a sensitivity of the microphone.

9. The method according to claim 8, further comprising detecting a release voltage.

10. The method according to claim 9, wherein setting the second AC bias voltage or DC bias voltage comprising setting the second AC bias voltage or DC bias voltage based on the pull-in voltage and the release voltage.

11. The method according to claim 8, further comprising calculating a difference between the sensitivity of the microphone and a target sensitivity of the microphone.

12. The method according to claim 11, further comprising adjusting a gain setting in an amplifier based on the calculated difference between the sensitivity and the target sensitivity.

13. A microphone comprising:

a MEMS device comprising a membrane and a backplate, wherein the MEMS device comprises a first terminal electrically connected to the membrane and a second terminal electrically connected to the backplate;

an AC bias voltage source electrically connected to the first terminal electrically connected to the membrane; and a DC bias voltage source electrically connected to the second terminal electrically connected to the backplate.

14. The microphone according to claim 13, further comprising an amplifier unit comprising an input and an output, wherein the input of the amplifier unit is connected to the MEMS device, and the output of the amplifier unit is connected to an output terminal of the microphone.

15. The microphone according to claim 13, further comprising an amplifier unit comprising an input and an output, wherein the input of the amplifier unit is connected to the MEMS device, and the output of the amplifier unit is connected to an analog/digital converter (ADC).

16. The microphone according to claim 13, further comprising a digital control unit, wherein the digital control unit is configured to measure a pull-in voltage and/or a release voltage of the MEMS device and configured to set an AC bias voltage of the AC bias voltage source or a DC bias voltage source of the DC bias voltage source.

17. The microphone according to claim 16, wherein the AC bias voltage comprises a frequency between about 1 Hz and about 50 Hz.

18. An apparatus comprising: a MEMS device for sensing an acoustic signal; a bias voltage source for providing an AC bias voltage to the MEMS device; and a control unit for detecting a pull-in voltage and for setting the AC bias voltage or a DC bias voltage, wherein the bias voltage source provides an AC bias voltage comprising a frequency between about 1 Hz to about 50 Hz.

19. The apparatus according to claim 18, further comprising an amplifier unit for amplifying an output signal of the MEMS device, wherein the amplifier unit comprises an input terminal and an output terminal.

20. The apparatus according to claim 19, wherein the control unit detects the pull-in voltage at the input terminal of the amplifier unit.

21. The microphone according to claim 13, further comprising a control unit configured to measure a pull-in voltage and/or a release voltage of the MEMS device.

22. The microphone according to claim 13, further comprising a control unit configured to set the AC bias voltage or a DC bias voltage of the DC bias voltage source.

23. The microphone according to claim 13, wherein the AC bias voltage comprises a frequency from 1 Hz to 50 Hz.

* * * * *